United States Patent [19]

Asche

[11] 4,150,504

[45] Apr. 24, 1979

[54] STABILIZED DIGGING MECHANISM

[75] Inventor: James E. Asche, Milnor, N. Dak.

[73] Assignee: Clark Equipment Company, Buchanan, Mich.

[21] Appl. No.: 875,823

[22] Filed: Feb. 7, 1978

[51] Int. Cl.[2] ..... E02F 5/02; E02F 3/00

[52] U.S. Cl. ..... 37/103; 414/694

[58] Field of Search ..... 37/103, 117.5, DIG. 3; 214/131 R, 131 A, 132, 138 R, 138 D, 768, 770, 773, 774, 775, 776

[56] References Cited

U.S. PATENT DOCUMENTS

| | | | |
|---|---|---|---|
| 2,846,094 | 8/1958 | Pilch | 37/103 |
| 2,880,894 | 4/1959 | Walker | 37/103 X |
| 3,003,651 | 10/1961 | Holopainen | 214/138 R |
| 3,984,016 | 10/1976 | Kuhn | 214/131 A |

FOREIGN PATENT DOCUMENTS

| | | | |
|---|---|---|---|
| 2639076 | 3/1977 | Fed. Rep. of Germany | 37/103 |
| 887805 | 1/1962 | United Kingdom | 214/770 |

*Primary Examiner*—E. H. Eickholt

*Attorney, Agent, or Firm*—Ernst H. Ruf

[57] ABSTRACT

A hydraulically actuated digging mechanism is removably securable to the tilt frame of a mobile shovel loader when the loader bucket is removed from the tilt frame; and a pair of stabilizer links are removably attachable to the tilt frame and to the lift arms of the shovel loader to support the weight of the digging mechanism without dependence upon the tilt actuator of the shovel loader, and to prevent accidental raising of the lift arms.

9 Claims, 5 Drawing Figures

STABILIZED DIGGING MECHANISM

BACKGROUND OF THE INVENTION

1. Field of the Invention

The present invention relates generally to mobile vehicles with a hydraulically actuated digging mechanism mounted thereto, and more particularly to mobile shovel loaders of the type having a removable loader bucket which is replacable with a hydraulically actuated hoe.

2. Description of the Prior Art

The prior art includes a skid steer shovel loader having a pair of lift arms, having a tilt frame pivotally secured to the lift arms, having a loader bucket that is removably attachable to the tilt frame, and having a hydraulically actuated hoe that is removably attachable to the tile frame.

SUMMARY OF THE INVENTION

In accordance with the broader aspects of this invention, there is provided a mobile vehicle of the type which includes a main frame, a lift arm having a first end that is pivotally attached to the main frame and having a second end, a first fluid actuator being connected to the main frame and to second end of said lift arm, a tilt frame being pivotally attached to the lift arm proximal to the second end thereof, a second fluid actuator being connected to said lift arm and to the tilt frame, an implement being removably attached to the tilt frame, a second implement having a movable and powered working element and being removably attachable to the tilt frame when the first implement is not attached thereto, and a stabilizer link being removably connectable to the tilt frame and to the second implement means and being effective to prevent the weight of the second implement from rotating the tilt frame without dependence upon the second fluid actuator.

It is a first object of the present invention to support the weight of an object which is attached to the tilt frame of a shovel loader without dependence upon the tilt cylinder of the shovel loader.

It is a second object of the present invention to prevent accidental raising of the tilt arms of a shovel loader when an optional implement is attached to the tilt frame of the shovel loader in the place of the loader bucket thereof.

It is a third object of the present invention to provide stabilizer links for supporting the weight of an optional implement which is attached to the tilt frame of a shovel loader without dependence upon the tilt cylinder of the shovel loader.

It is a fourth object of the present invention to pivotally interconnect the lift arms and the tilt frame of the shovel loader with a stabilizer link that has a different arc of rotation than that of the lift arm, whereby raising of the lift arm to dangerous heights is prevented by interaction of said arcs of rotation.

These and other advantages and objects of the present invention will be readily apparent when referring to the following detailed descriptions wherein:

DESCRIPTION OF THE PREFERRED EMBODIMENT

Figure 1:
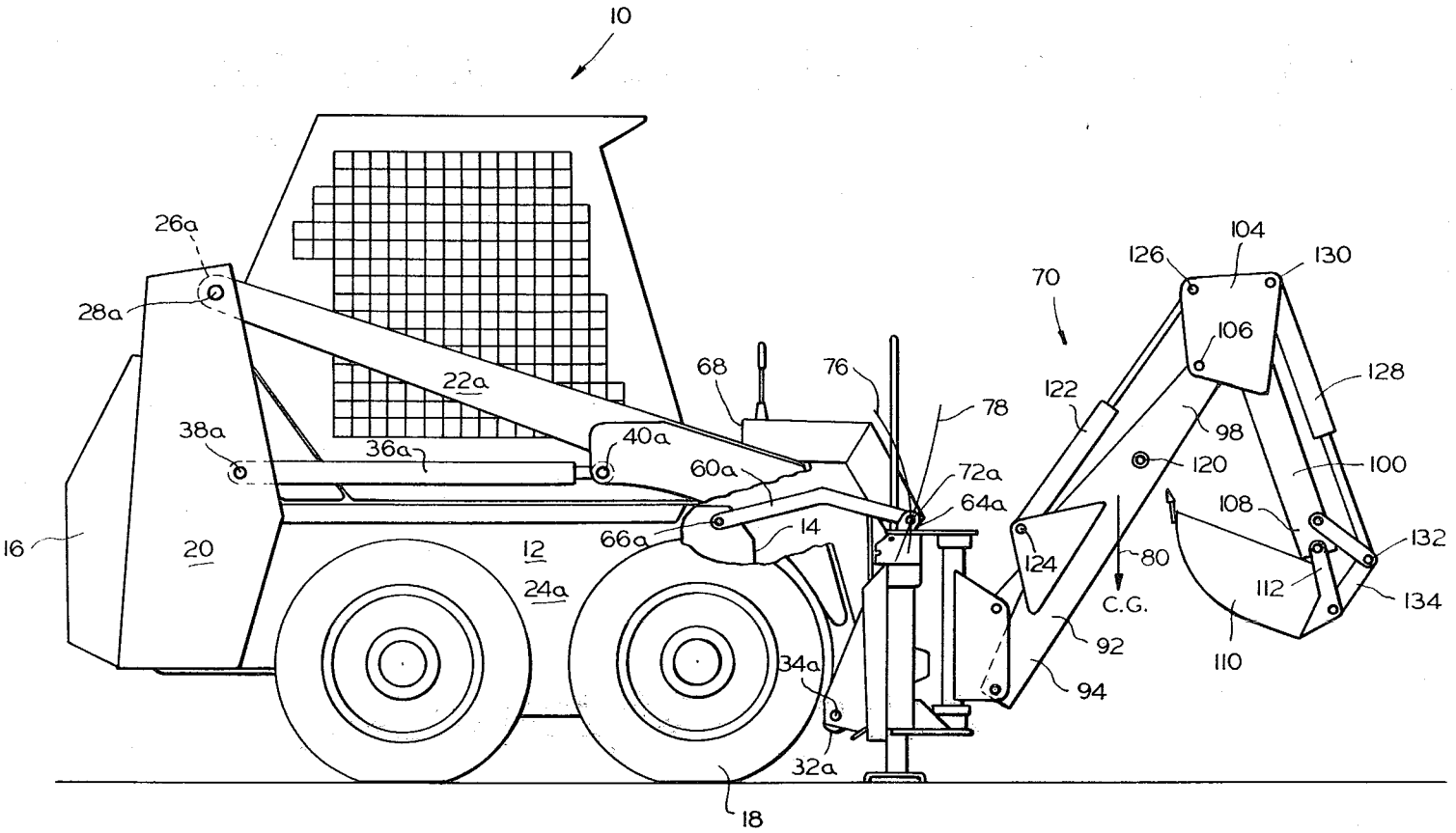
FIG. 1 is a side elevation of the mobile shovel loader of the present invention with the loader bucket thereof removed, with the hydraulically actuated digging mechanism thereof attached in place of the loader bucket, and with the stabilizer links interconnecting the lift arms and the tilt frame.
Figure 3:
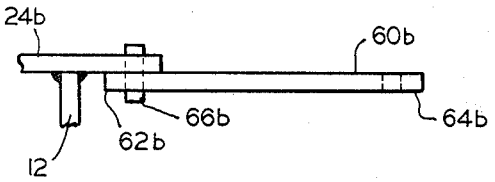
FIG. 3 is a partial top elevation of the shovel loader of FIG. 1, taken substantially as shown by view line 3—3 of FIG. 2, showing one of the stabilizer links and a portion of the main frame of the shovel loader.
Figure 4:
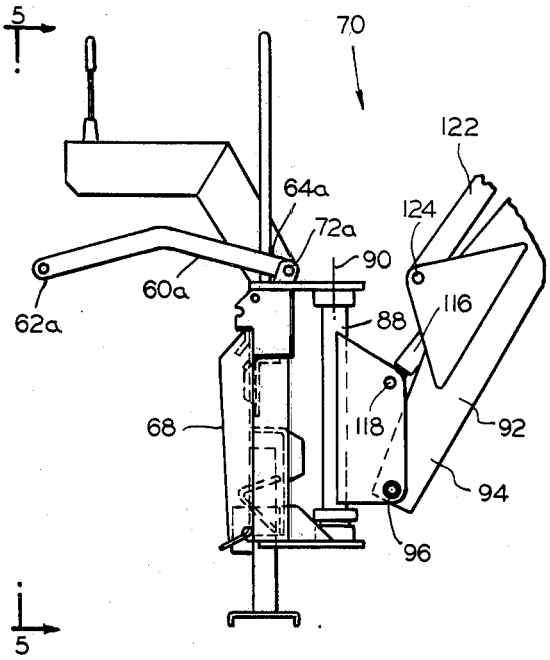
FIG. 4 is a side elevation of the hydraulically actuated digging mechanism of the mobile shovel loader of FIG. 1, taken substantially as shown in FIG. 1, and showing one of the stablizer links.

Referring now to FIGS. 1, 3, and 4, a mobile vehicle or mobile shovel loader 10 includes a main frame 12 having a first end 14 and a second end 16, and being supportably and mobilely mounted upon wheels 18. The frame 12 includes an upright 20 which is proximal to the second end 16 of the frame 12. A pair of spaced-apart lift arms 22*a* and 22*b* are disposed proximal to respective ones of spaced-apart sides 24*a* and 24*b* of the frame 12. The lift arms 22*a* and 22*b* are similar, are pivotally attached in similar locations and in similar manners, and are hydraulically actuated by similar means so that a description of one will suffice for both. The lift arm 22*a* includes a first end 26*a* that is pivotally mounted to the frame 12 proximal to the end 16 thereof by a pivot pin 28*a* that is disposed on a horizontal or transverse pivot axis. The mobile shovel loader 10 also includes a tilt frame 30 which is pivotally attached to the lift arms 22*a* and 22*b*, the tilt frame 30 being pivotally attached to the lift arm 22*a* proximal to a second end 32*a* thereof by a pivot pin 34*a* which is disposed on a pivotal axis which is substantially parallel to the pivot axis of the pivot pin 28*a*. A first hydraulic actuator or first fluid actuator means 36*a* is pivotally connected to a frame 12 by a pin 38*a* and to the lift arm 22*a* by a pin 40*a* so that extension of the first hydraulic actuator 36*a* is effective to lift the second end 32*a* of the lift arm 22*a*.

Figure 2:
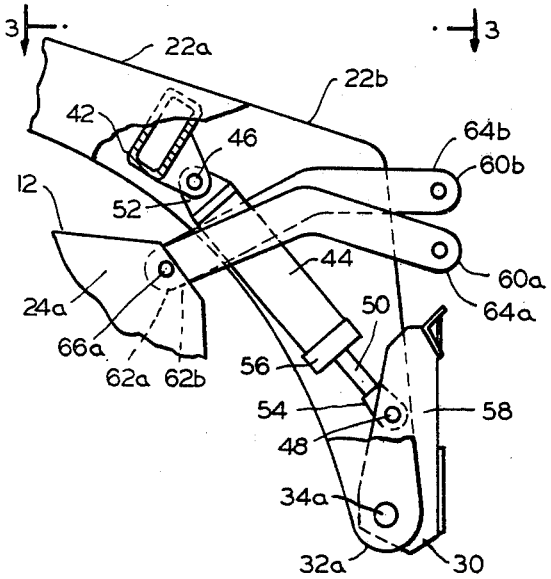
FIG. 2 is a partial side elevation of the mobile shovel loader of FIG. 1 taken substantially as shown in FIG. 1, and showing the lift arms, tilt frame, and stabilizer links.

Referring now to FIGS. 1 and 2, and more particularly to FIG. 3, the spaced-apart lift arms 22*a* and 22*b* are interconnected by a spacing bar 42; and a second hydraulic actuator or tilt actuator 44 serves as a second fluid actuator means and is interconnected between the tilt frame 30 and the spacing bar 42 by pins 46 and 48 which are disposed substantially parallel to the pivot pin 28*a*.

The tilt actuator 44 includes both maximum extended and minimum closed lengths which are typical of fluid actuators of this type and which do not constitute inventive concepts of the present invention. It is typical in a design of hydraulic actuators such as the actuator 44 that the minimum closed length is controlled by a piston rod, such as a piston rod 50 of the actuator 44, contacting a head end clevis, such as a head end clevis 52 of the actuator 44. However, for illustrational purposes herein, it is assumed that a rod end clevis 54 of the actuator 44 contacts a cylinder head 56 of the actuator 44 to provide a stop for the minimum closed length of the actuator 44. Thus, with a mounting face 58 of the tilt frame 30 in a substantially vertical position as shown, the tilt frame 30 can rotate in a counterclockwise rotation around the pivot pin 34a until the rod end clevis 54 contacts the cylinder head 56. It will be apparent to those skilled in the art that the manner of achieving a stop for the rotation of the tilt frame in the counterclockwise direction is a matter of choice and not of inventive concept.

Referring now to FIGS. 1, and 3–6, a pair of stabilizer links 60a and 60b include respectively, first ends 62a and 62b and second ends 64a and 64b. The first ends 62a and 62b are respectively connected to sides 24a and 24b of the main frame 12 by respective ones of pins 66a and 66b; and the second ends 64a and 64b of the stabilizer links 60a and 60b are pivotally connected to a mounting structure 68 of a hydraulically actuated digging mechanism or second implement means 70 which preferably comprises a hydraulically actuated hoe. This connection of the second ends 64a and 64b of the stabilizer links 60a and 60b to the mounting structure 68 is by means of pivot pins 72a and 72b which engage respective ones of pivot lugs 74, the pivot lugs 74 being welded to the mounting structure 68.

Referring again to FIGS. 1, and 3–6, the pivot pin 28a is on a horizontal or transverse axis; and the pivot pin 34a, the pin 38a, the pin 40a, the pins 46 and 48, the pins 66a and 66b, and the pivot pins 72a and 72b are all disposed substantially parallel to the pivot pin 28a.

The stabilizer links 60a and 60b provide stabilizer means for supporting the weight of the hydraulically actuated digging mechanism 70 which has a center of gravity that is located at 80, preventing clockwise rotation of the tilt frame 30 about the pivot pin 34a without dependence upon the tilt actuator 44.

In addition, the stabilizer links provide a means for preventing accidental raising of the digging mechanism 70 by accidental actuation of the first hydraulic actuator 36a; since, to raise the lift arm 22a, the arc of rotation 78 of the pivot pin 72a rotating about the pivot pin 28a must coincide with the arc of rotation 76 of the pivot pin 72a rotating about the pivot pin 66a. Thus, in order to raise the lift arm 22a, both the first hydraulic actuator 36a and the tilt actuator 44 must be simultaneously and precisely actuated, the tilt actuator 44 closing as the first hydraulic actuator 36a extends, to make the arc of rotation 78 coincide with the arc of rotation 76.

Further, as shown in FIG. 3, the tilt actuator 44 is near the minimum closed length thereof as shown by the proximity of the rod end clevis 54 and the cylinder head 56; and so raising of the lift arms 22a and 22b to any substantial height is prevented, as can be clearly seen by the divergence of the arcs of rotation 76 and 78. Specifically, a mechanical means, which may comprise the proximity of the rod end clevis 54 and the cylinder head 56, is provided to prevent tilt frame 30 from tilting in a counterclockwise direction about the pivot pin 34a to a position which will allow the lift arms 22a and 22b to be lifted more than one-half of the height that the lift arms 22a and 22b may be lifted by the first fluid actuator means 36a when the stabilizer links 60a and 60b are not interconnected between respective ones of the lift arms 22a and the mounting structure 68.

Figure 5:
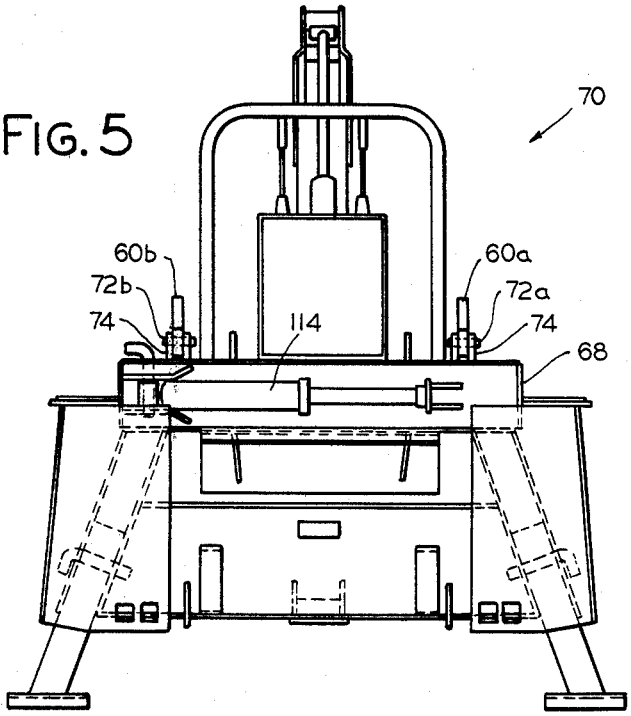
FIG. 5 is an end elevation of the hydraulically actuated digging mechanism, taken substantially as shown by view line 5—5 of FIG. 4.

Referring now to FIGS. 1, 5, and 6, the hydraulically actuated hoe 70 is of a design and construction which is common to the art, does not comprise a part of the present invention, and so does not require a detailed description. However, briefly, the hydraulically actuated hoe 70 includes the mounting structure 68, a swing mast 88 which is pivotally secured to the mounting structure 68 for rotation about a vertically disposed pivot axis 90, a boom 92 which includes a first end 94 that is pivotally secured to the swing mast 88 about a horizontally disposed pivot axis by a pivot pin 96 and which includes a second end 98, a dipper stick 100 which includes a first end 102 that comprises a plate clevis 104 and that is pivotally connected to the second end 98 of the boom 92 by a pin 106 and which includes a second end 108, a digging bucket or movable and powered working element 110 that is pivotally connected proximal to the second end 108 of the dipper stick 100 by links 112, a hydraulic swing actuator 114 that is connected to the mounting structure 68 and to the swing mast 88, the method of connection not being shown and not constituting a part of the present invention, a hydraulic boom lift actuator 116 that is pivotally connected to the swing mast 88 by a pin 118 and to the boom 92 by a pin 120, a hydraulic crowd actuator 122 that is connected to the boom 92 by a pin 124 and to the dipper stick 100 by a pin 126, a hydraulic bucket curl actuator 128 that is connected to the dipper stick 100 by a pin 130 and to the links 112 of the bucket 110 by a pin 132 and a link 134.

In conclusion, the present invention provides stabilizer means for supporting the weight of an implement which may be optionally attached to the tilt frame of a mobile shovel loader without depending upon the tilt actuator for such support; and means is provided for preventing accidental raising of the attached implement to dangerous heights.

While only a single embodiment of the present invention has been described in detail, it will be understood that the detailed description is intended to be illustrative only and that various modifications and changes may be made to the present invention without departing from the spirit and scope of it. Therefore the limits of the present invention should be determined from the attached claims.

What is claimed is:

1. In a mobile vehicle of the type which includes a main frame, a lift arm having a first end that is pivotally attached to said main frame on a horizontally disposed first pivot axis and having a second end, first fluid actuator means for lifting said second end of said lift arm, a tilt frame being pivotally attached to said lift arm proximal to said second end thereof on a second pivot axis that is substantially parallel to said first pivot axis, second fluid actuator means for tilting said tilt frame about said second pivot axis with respect to said lift arm, and implement means being attached to said tilt frame for performing work in response to actuation of said lift arm and said tilt frame by said first and second fluid actuator means, the improvement which comprises:

second implement means, having a weight with the center of gravity thereof disposed longitudinally outward from said pivotal attachment of said tilt frame and being removably securable to said tilt frame when first said implement means is not attached thereto, for performing work without actuation of either of said fluid actuator means; and stabilizer means for preventing said weight of said second implement means from rotating said tilt frame about said pivotal attachment thereof without dependence upon said second fluid actuator means.

2. A mobile vehicle as claimed in claim 1 in which said stabilizer means comprises a stabilizer link having a first end that is connected to said main frame, and having a second end that is connected to said second implement means.

3. A mobile vehicle as claimed in claim 2 in which said connections of said stabilizer link comprise pivotally attaching said first end thereof on an axis that is substantially parallel to said horizontal pivot axis of said attaching of said lift arm to said main frame and that is longitudinally spaced-apart therefrom, and pivotally attaching said second end of said stabilizer link to said second implement means distal from said pivotal attaching of said tilt frame to said lift arm; whereby said second ends of said lift arm and said stabilizer link have different arcs of rotation, and said difference in said arcs of rotation of said second end of said lift arm and said second end of said stabilizer link prevents raising of said lift arms without a corresponding tilting of said tilt frame, so that accidental raising of said lift arm by accidental actuation of said first fluid actuator is prevented.

4. A mobile vehicle as claimed in claim 3 in which said vehicle includes mechanical means for preventing said tilt frame from tilting to a position wherein said stabilizer link will allow said first fluid actuator means to raise said lift arm more than one-half of the distance that said first fluid actuator means can raise said lift arm when first said implement means is attached to said tilt frame and said stabilizer link is disconnected.

5. A mobile vehicle as claimed in claim 4 in which said second hydraulic actuator means includes a maximum extended length and a minimum closed length; and said mechanical means comprises said minimum closed length.

6. In a mobile shovel loader of the type which includes a main frame having first and second ends and a pair of spaced-apart sides, a pair of spaced-apart lift arms each having a first end that is pivotally secured to a proximal one of said sides distal from said first end of said frame on a transverse pivot axis and each having a second end that extends longitudinally outward from said first end of said main frame, first and secod hydraulic actuators each being attached to a respective one of said lift arms distal from the respective one of said first ends thereof and each being attached to said frame, a tilt frame being transversely disposed with respect to said lift arms and being pivotally attached thereto on a transverse axis proximal to said second ends thereof, a third hydraulic actuator being pivotally attached to said lift arms and to said tilt frame for selectively tilting said tilt frame about said pivotal attachment thereof, and a loader bucket being removably attached to said tilt frame, the improvement which comprises:

a hydraulically actuated digging mechanism, including a movable and powered working element, having a weight with the center of gravity thereof disposed longitudinally outward from said pivotal attachment of said tilt frame and being removably securable to said tilt frame when said loader bucket is not attached thereto; and stabilizer means for preventing said weight of said digging mechanism from rotating said tilt frame about said pivotal attachment thereof without dependence upon said third hydraulic actuator.

7. A mobile shovel loader as claimed in claim 6 in which said hydraulically actuated digging mechanism comprises a hydraulically actuated hoe, and said movable and powered working element comprises a digging bucket.

8. A mobile shovel loader as claimed in claim 7 in which said hydraulically actuated hoe comprises a mounting structure, a swing mast being disposed for rotation about a vertical axis and being pivotally secured to said mounting struture, hydraulic swing actuator means for rotating said swing mast, a boom having a first end that is pivotally secured to said swing mast about a horizontal pivot axis and having a second end, a hydraulic boom actuator being pivotally secured to said boom distal from said first end thereof and being pivotally secured to said pivot mast, a dipper stick having a first end that is pivotally secured to said boom proximal to said second end thereof on a substantially horizontal pivot axis and having a second end, a hydralic crowd actuator being pivotally secured to said dipper stick proximal to said first end thereof and being pivotally secured to said boom, said digging bucket being pivotally secured to said dipper stick proximal to said second end thereof, and a hydraulic bucket curl actuator being operatively connected to said digging bucket and to said dipper stick; whereby said power of said movable and powered bucket comprises said boom actuator, said crowd actuator, and said bucket curl actuator.

* * * * *